US005669248A

United States Patent [19]

Mista et al.

[11] Patent Number: 5,669,248

[45] Date of Patent: Sep. 23, 1997

[54] TEXTILE MACHINES, IN PARTICULAR WARP KNITTING MACHINES, WITH THREAD LIFTING ELEMENTS

[75] Inventors: Kresimir Mista, Heusenstamm; Joachim Fischer, Rodgau, both of Germany

[73] Assignee: Karl Mayer Textilmachinenfabrik GmbH, Obertshausen, Germany

[21] Appl. No.: 631,166

[22] Filed: Mar. 12, 1996

[30] Foreign Application Priority Data

Apr. 24, 1995 [DE] Germany ..... 195 14 995.5

[51] Int. Cl.[6] ..... D04B 27/24; D04B 27/32

[52] U.S. Cl. ..... 66/205; 66/214

[58] Field of Search ..... 139/455; 66/205, 66/214

[56] References Cited

U.S. PATENT DOCUMENTS

| | | | |
|---|---|---|---|
| 4,285,217 | 8/1981 | Mista et al. | 66/205 |
| 4,590,776 | 5/1986 | Bonaschi | 66/205 |
| 4,690,178 | 9/1987 | Bassi et al. | 139/455 |
| 4,739,806 | 4/1988 | Palau et al. | 139/455 |
| 5,002,099 | 3/1991 | Seiler | 139/455 |
| 5,070,913 | 12/1991 | Palmer | 139/455 X |
| 5,133,389 | 7/1992 | Griffith | 139/455 |
| 5,373,871 | 12/1994 | Speich | 139/455 |
| 5,392,820 | 2/1995 | Seiler | 139/455 |

FOREIGN PATENT DOCUMENTS

| | | | |
|---|---|---|---|
| 2104735 | 4/1990 | Japan | 139/455 |
| 3260133 | 11/1991 | Japan | 139/455 |
| 5163628 | 1/1993 | Japan | 139/455 |

*Primary Examiner*—John J. Calvert
*Attorney, Agent, or Firm*—Omri M. Behr, Esq.

[57] ABSTRACT

Textile machine in particular a warp knitting machine having attached, side-by-side, on a carrier (1), stroke elements (2) which grip on the threads, which are individually displayable in the longitudinal direction. To the carrier (1), are provided control element (21) which are electrically activatable and can be brought into two positions. A common activating arrangement (8) which runs along the length of the carrier (1) and is driveable to and fro in the stroke direction, influences the stroke element (2) in the first position of the appropriate control element (21) in the at-rest position and carries it with it in its second position in a working mode. In this manner it is possible to control the individual stroke elements without the need for harness cords.

24 Claims, 4 Drawing Sheets

TEXTILE MACHINES, IN PARTICULAR WARP KNITTING MACHINES, WITH THREAD LIFTING ELEMENTS

BACKGROUND OF THE INVENTION

1. Field of the Invention

The invention is directed to a textile machine, for example, a warp knitting machine, having, on a carrier and next to each other, stroke elements which are longitudinally displaceable by means of pattern dependent activatable individual control elements.

2. Description of Related Art

Such a textile machine is known from German Patent 12 24 863 to Lebrand, et al. In this device, guides attached to a guide bar are pulled by means of harness cords, from a lower, neutral position, to an upper working position and, by means of a common, spring biased return rail, are again returned to the neutral position. Such a construction is disadvantageous because the plurality of harness cords make access to the machine difficult, requires the use of a considerable amount of space and harness cords are only able to exercise tensile forces, An object of the present invention is to provide a textile machine of the prior art type in which the individual control of stroke elements can occur without the use of harness cords.

SUMMARY OF THE INVENTION

In accordance with the illustrative embodiments demonstrating features and advantages of the present invention, there is provided a textile machine for a warp knitting machine, a weaving loom or other textile equipment. The textile machine has a carrier and a thread-gripping plurality of stroke elements mounted side-by-side on the carrier. These stroke elements are individually and longitudinally displaceable in a stroke direction. Also included is a pattern-following plurality of control elements mounted on the carrier and electrically activatable to be brought into a first and a second position for affecting displacement of the stroke elements. The textile machine also has a single, common, activating arrangement running the length of the carrier and reciprocatable in the stroke direction for carrying into a working position those ones of the stroke elements associated with selected ones of the control elements that are in the second position.

Machines constructed in accordance with the teachings of the present invention can have control elements provided to a carrier. These control elements can be electrically activatable, and can be brought into either of two positions. A preferred activating arrangement that is reciprocated in the stroke direction, stretches the length of the carrier and in one of its first positions, takes the stroke element into a working position.

In such an embodiment, the control elements and the activating arrangements are provided proximate to the stroke element so that access to the machines is not hindered by harness cords or the like. The necessary cables for electrical activation may be displaced without any problems. The carrier with the appropriate control elements, lifting elements, and activating arrangement, can be built as a unit and replaced if necessary. Because of the limited availability of space, it is desirable to use comparatively small control elements with appropriately small displacement movements. These are sufficient however since the control elements do not carry out the stroke of the stroke elements but only need to activate the coupling between the activating arrangement and the chosen stroke element.

It is advantageous to provide a return spring to each stroke element and that the coupling between the activating arrangement and the stroke element operates as a force transfer. The thus resulting pressure forces can be transferred from the activating arrangement onto the stroke element through comparatively small striker surfaces.

In an advantageous embodiment, the control elements are provided to the activating arrangement and will grip, in their second position, onto the appropriate stroke elements. The control elements thus lie in the power train.

A very desirable alternative may be found in that the control elements are provided to the carrier and in their first position hold a coupling element adjustable with the appropriate stroke element in a non-working position out of contact with the activation arrangement. This allows greater freedom in the design of the control element since the displacing forces do not run over the control element.

It is advantageous to provide the coupling element with a latch hinged to the stroke element and which is frictionally held in the non-working position by the control element. Since the latch is held in place by frictional forces, it is sufficient for the control element to transmit comparatively small forces onto the latch handle.

The holding ability in the non-working position is improved in that a striker is provided to each latch handle which is pressed against by the appropriate control element.

An appropriate mode of achieving this which can also be used in combination, is found in that the mutually interactive surface of the control element and the handle are roughened.

It is exceedingly advantageous to provide the latch or the control element with a depression into which the other element can intrude. In this way, there is provided a safety means which ensures that even under vibrations, the latch is held in its non-working position. A very small depression is all that is necessary, suitably in the order of a few tenths of a millimeter, for example 0.3 mm.

It is advantageous that the activating arrangement, before displacement of the selected stroke element, carries out a movement whereby it brings the latch into the non-working position, working against the force of a spring. Herein the activating element does not run on a straight path. The appropriate sidewards component may be obtained by means of a linkage.

It is particularly advantageous to provide the control elements as one sided, fixed piezoelectric transducers. These have a very small space requirement. Furthermore, they do not generate substantial forces. The displacement of their free ends however, is sufficient to move from a first position into a clearly differentiable second position.

It is advantageous to provide the transducers parallel and next to each other, separated from the stroke elements. The free ends of the transducers are displaceable in the longitudinal direction of the carrier. In this manner, it is possible to arrange the transducers with a separation from each other that is so small that it corresponds to the division between neighboring stroke elements.

From U.S. Pat. No. 5,390,512, it is already known to provide the free end of a one end, fixed piezoelectric transducer with a thread guide and to so arrange matters that this thread guide is displaced by one needle space upon activation of the transducer. This displacement movement is nevertheless small in comparison to the conventional stroke movement which in the longitudinal direction of displaceable stroke elements can be between 2 and 50 mm and runs perpendicular to this stroke motion.

In a preferred embodiment, every transducer is provided in the same level as the appropriate stroke element and grips symmetrically to the stroke element. This leads to a space saving mode of construction and to an even loading during the displacement motion.

It is also advantageous that the control elements are grouped together in a construction unit and its electronic leads are grouped together in a cable with a single contact plug. Each construction unit can be simply built and readily swapped out with other units.

It is furthermore desirable that the stroke elements are each provided with a setting means with a separatable thread guide attached thereto. If the thread guide is abraded or damaged, it is merely necessary to exchange this thread guide. The total remaining construction can thus remain without interference.

BRIEF DESCRIPTION OF THE DRAWINGS

The invention may further be elucidated by the following drawings, which further illustrate the preferred embodiments.

DETAILED DESCRIPTION OF THE PREFERRED EMBODIMENTS

Figures 1, 2, 3:
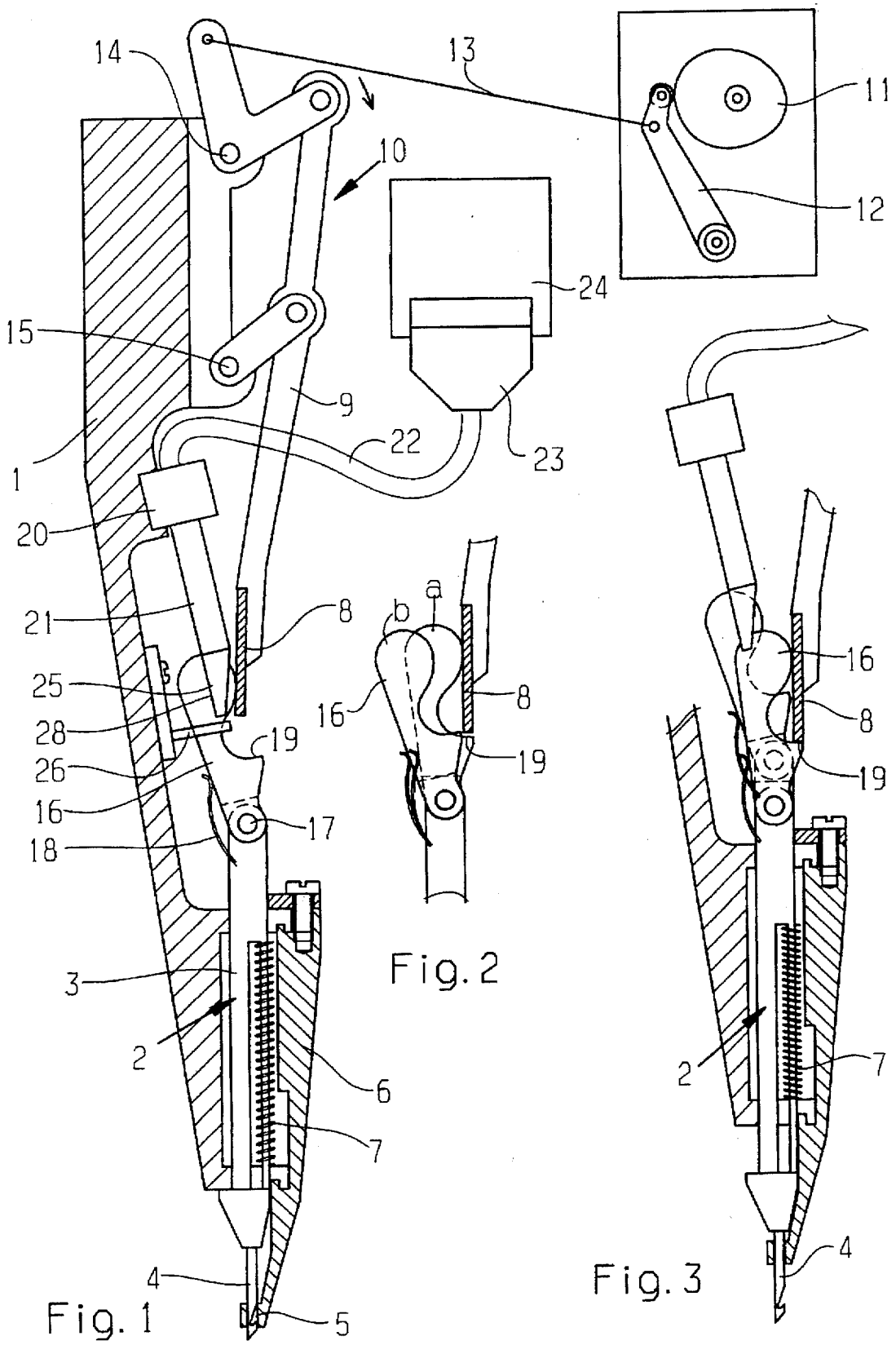
FIG. 1 is a cross-section of the carrier showing a stroke element in the at-rest position.
FIG. 2 is a partial, cross-sectional view of the latch of FIG. 1.
FIG. 3 is a partial, cross-sectional, elevational view of the carrier of FIG. 1 showing the stroke element in the working position.
Figures 4, 5:
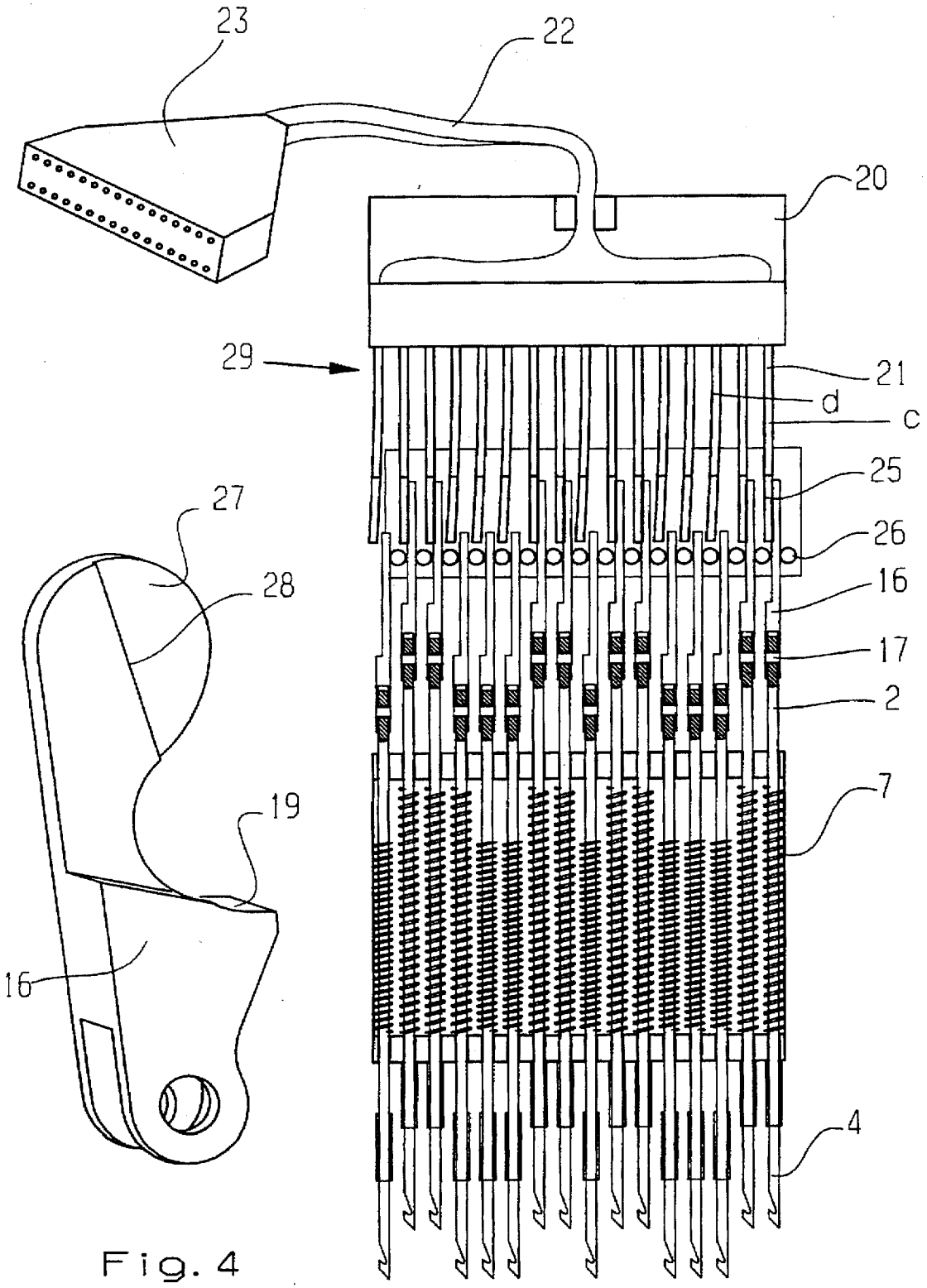
FIG. 4 is an enlarged perspective view of the latch of FIG. 1.
FIG. 5 is a front elevational view of a group of control elements and stroke elements in the embodiment of FIG. 1.

The embodiment of FIGS. 1 through 6 show a carrier (1) which stretches across the entire breadth of a warp knitting machine. The stroke elements (2) are placed in a row next to each other. They comprise a setting member (3) and a thread guide (4) in the form of a hook-shaped gripping means. The thread guides (4) are removably fixed in the setting members (3). The stroke element (2), is displaceable from the at-rest position shown in FIG. 1, in which the hook of the thread guide is provided in a bore (5) which is provided in a covering means (6). Element (2) is displaceable against the force of a return spring (7) into the working position shown in FIG. 3, in which the hook of the thread guide (4) is released. In the at-rest position therefore, the threads which were grasped in the working position are clamped tight.

For the displacement of the stroke element (2), an activating arrangement (8) is provided over the breadth of the machine in the form of a ledge, which is attached to a lever arm (9) of a linkage (10) which is cyclically driven by a cam (11) via a drive lever (12) and a rod means (13). The fixed bearings (14 and 15) of the linkage (10) are attached to the carrier (1).

The activating arrangement (8) operates together with latches (16) which are hinged to stroke elements (2) by hinges (17) and are biased in a clockwise direction by springs (18). These springs (18) are counteracted when the latch follows the activating arrangement (8) through its downward gravitational force. Every latch (16) can take up two positions, namely an active position "a" wherein the activating arrangement (8) contacts a striker (19) on the latch and a non-working position "b" in which the activating means (8) moves past the striker (19) as shown in FIG. 2. In the active position "a" the activating arrangement (8) is coupled in a force transmitting manner with stroke element (2) via latch (16) so the former is moved into the working position of FIG. 3. In the non-working setting "b," per contra, the stroke element (2) is not influenced, thus remains in the at-rest position of FIG. 1.

A block (20) is affixed to carrier (1) in which a plurality of control elements (21) in the form of single end, fixed (cantilevered) piezoelectric transducers are held. The control elements are controlled by electrical potential over conductors in a common cable (22). The cable (22) is provided with a plug (23), which provides a connection to a pattern-forming control apparatus (24). By the application of potential, the free end (25) of control element (21) is so displaced that the control element can take up two positions. In the first position (c) (see FIG. 5), the control element (21) lies with its free end (25) in frictional connection onto latch (16) and presses this against a rod formed striker (26). This, in combination with a rough surface on free end (25) and on the latch (16), as well as in combination with a depression (27) on latch (16) (which forms a striker (28)) ensures that the latch maintains its non-working position (b) even when the machine generates vibrations.

During a displacement of the free end (25) of the control element, a second position (d) is reached in which the latch (16) is released. The released latch therefore follows the movement of the activating arrangement (8) out of the position of FIG. 1 into the position of FIG. 2 and further into the position of FIG. 3. Thus, selected stroke elements (2) are thus taken together with the activating arrangement (8) and pushed to the outside.

So that in each work cycle, one can make a choice among all the stroke elements (2), all the control elements (21) are brought into the second position (d) for a short time and all the latches (16) are pushed into the non-working position (b) by the activating arrangement (8), which is made possible by the corresponding design of the linkage (10). Thereafter, the translation of certain control elements (21) from the second position (d) into the first position (c) is activated so that the selected latches remain in the non-working position (b). Only the other, free latches return to the working position (a), which leads to activation of the stroke element (2).

When the non-selected control elements (21) are brought from positions (d) to (c), which may be the case with piezoelectric transducers, it is ensured that the latches 16 are held tight irrespective of electrical current interruption. This prevents an undesired release of the stroke elements (2), for example, during failure of the control means.

The control elements (21) are put together in a group of sixteen control elements, which can be constructed together as a building unit (29). The latches (16) are always located between two rod-formed strikers (26) and are thus securely guided.

Figure 6:
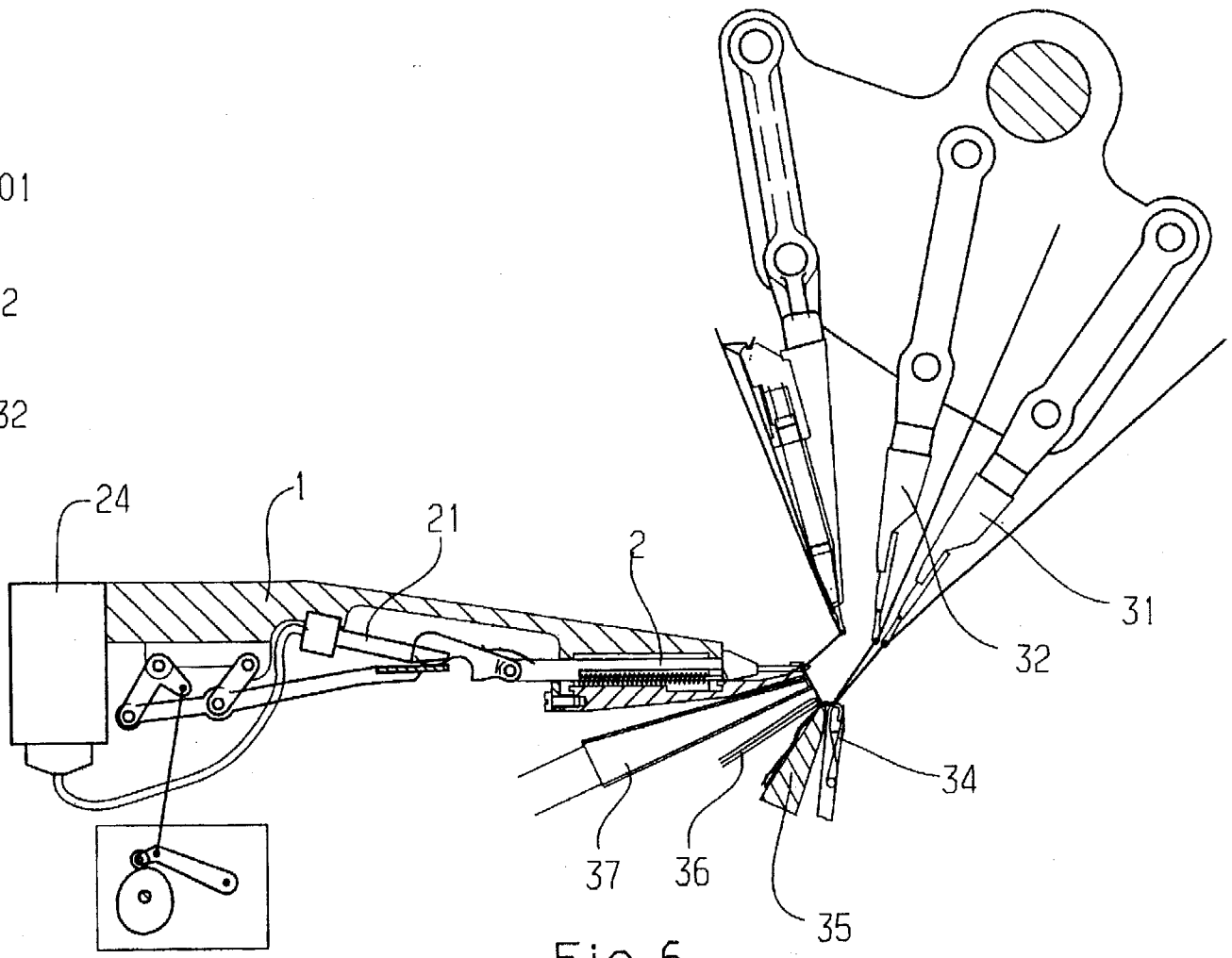
FIG. 6 is the embodiment of FIGS. 1 through 5 shown in a side elevational view as installed in a warp knitting machine.

FIG. 6 shows the manner of utilization of the carrier (1) in a warp knitting machine. This machine has two guide bars (31 and 32) with which the fabric ground is laid and a pattern guide bar (33) with which the pattern threads are provided for the formation of a pattern. Furthermore, the needles (34) are provided proximal to a knock-over arrangement (35). Proximal to the knock-over arrangement, a cutting arrangement (36) is provided. This is followed by a suction extraction arrangement (37). Over the latter, there is located the stroke element (2) with a thread guide (4) in the shape of a hook-formed gripping means. In this manner, the pattern threads can be gripped by the hook of the thread guide (4), clamped tight and cut off by the cutting arrangement (36). As soon as a new pattern should be laid, the pattern thread is again laid in front of the needle (34) and released by thread guide (4).

By this means, the pattern thread can form pattern segments which may be separated from areas free of these patterning threads. See German Patent Application P 44 33 222.4-26 (U.S. Ser. No. 526,545).

Figure 7:
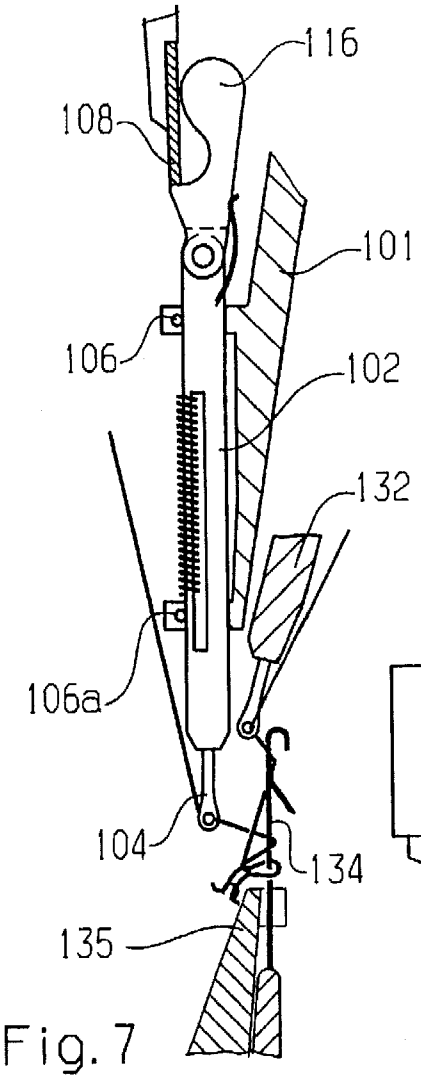
FIG. 7 is a modified embodiment of a hook-forming, stroke element.
Figure 8:
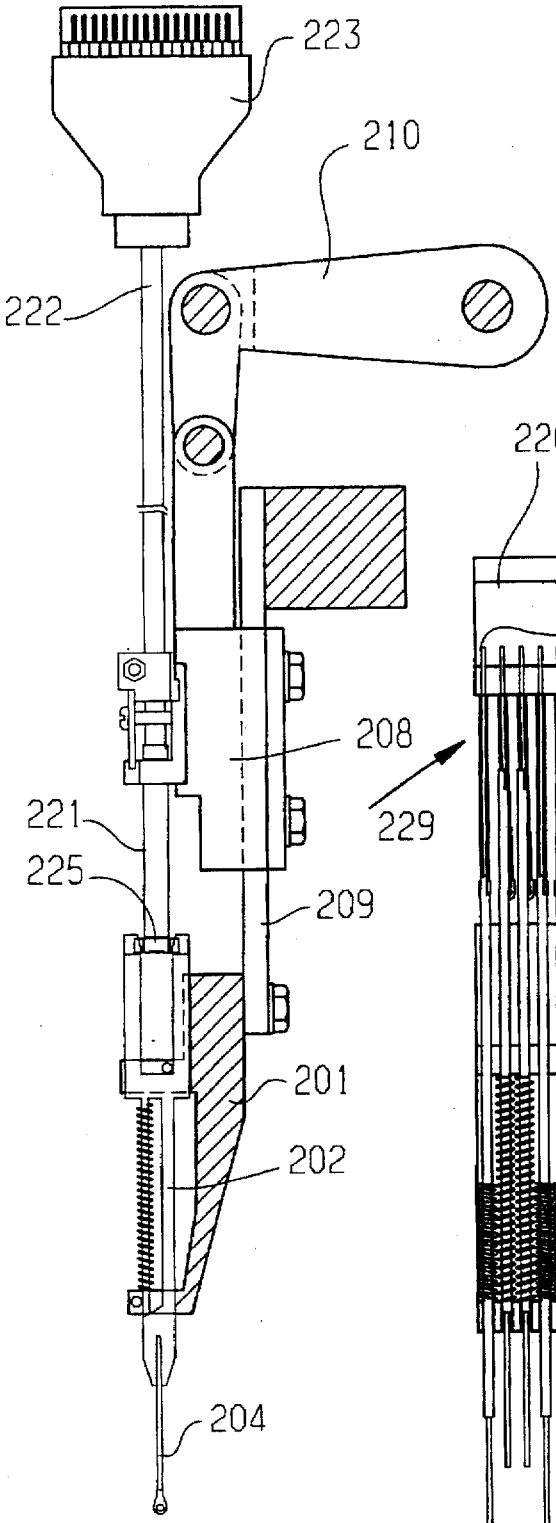
FIG. 8 is a cross-sectional, elevational view through a carrier according to a further embodiment.
Figure 10:
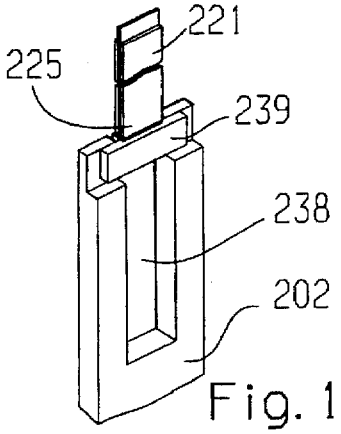
FIG. 10 is a detailed, perspective view of a stroke element in accordance with the embodiment of FIG. 8, showing the appropriate control element in the second position.

In the embodiment of FIG. 7, the corresponding items numbers are raised by 100. The thread guide (104) is in the form of a regular thread guide having an apertured head portion, which moves from the at-rest position (not shown) into the illustrated working position in order to lay a hook out of the provided thread. In place of the covering means (6), guide pegs (106) and (106*a*) are provided.

Figure 9:
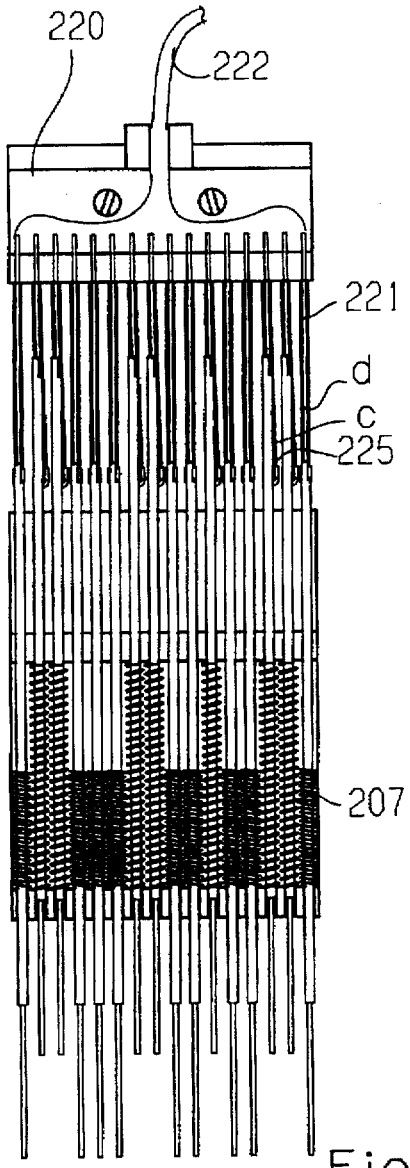
FIG. 9 is a front, elevational view of a group of control elements and stroke elements in accordance with the embodiment of FIG. 8.
Figure 11:
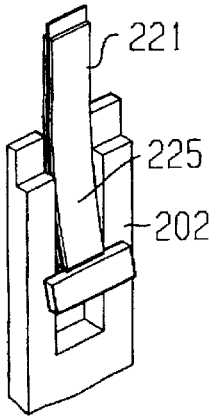
FIG. 11 is a detailed, perspective view of a stroke element in accordance with the embodiment of FIG. 8 with the appropriate control element in the first position.

In the embodiment of FIGS. 8 through 11, the item numbers for the corresponding components are raised by 200. The difference here lies in that the control elements (221) are fixed to the activating mechanism (208) which is moved up and down by rod means (210) and is thus connected to carrier (201) via rod means (209). The control elements (221), which may be in the form of piezoelectric transducers as shown in FIG. 9, can lie with their free ends (225) either sidewardly displaced and thus in the first position (c), or in the second position (d) against a striker on stroke element (202). The stroke element (202) has a central recess (238) into which the free end (225) of the control element (221) may enter in the displaced position (first position (c)). In this position, during the downward movement of the activating element (208), the stroke element (202) is not carried with it. The free end (225) carries a transverse beam (239) with which, in the second position (d), a pressure force is transferred to the stroke element (202) so that the stroke element (202) is carried downwardly.

The carriers can be affixed to the machine itself or can be provided in an axially displaceable manner so that the threads influenced by stroke motion can also permit overlaps and underlaps to be formed. Instead of the illustrated use, the same principle can also be used in the design formation in weaving looms.

We claim:

1. A textile machine for a warp knitting machine, a weaving loom or other textile equipment, comprising:

a carrier;

a thread-gripping plurality of stroke elements mounted side-by-side on said carrier, said stroke elements being individually and longitudinally displaceable in a stroke direction;

a pattern-following plurality of control elements mounted on said carrier and electrically activatable to be brought into a first and a second position for affecting displacement of said stroke elements;

a single, common, activating arrangement running the length of the carrier and reciprocatable in the stroke direction for carrying into a working position those ones of the stroke elements associated with selected ones of the control elements that are in the second position.

2. The textile machine in accordance with claim 1 wherein each stroke element comprises:

a return spring, the activating arrangement and the stroke elements being operable to couple in a force transferring manner.

3. The textile machine according to claim 1 wherein the control elements are mounted on the activating arrangement and are operable in the second position to grip associated ones of the stroke elements.

4. The textile machine in accordance with claim 1 wherein the control elements are attached to the carrier, said textile machine comprising:

a plurality of coupling elements separately connected to corresponding ones of said stroke elements, each of said control elements in the first position being operable to hold separate ones of said coupling elements in a non-working position to selectively deactivate the stroke elements and prevent a driving connection with the activating arrangement.

5. The textile machine in accordance with claim 4 wherein the coupling elements comprise:

a plurality of latches separately hinged to the stroke elements to be frictionally and selectively held in the non-working position by the control elements.

6. The textile machine in accordance with claim 5 comprising:

a spaced plurality of strikers attached to said carrier adjacent to and in correspondence with said latches, said control elements being positioned to separately press against said latches.

7. The textile machine in accordance with claim 6 wherein each of the control elements make contact with one of the latches along an interface that is superficially roughened at least partially.

8. The textile machine in accordance with claim 5 wherein each of the control elements make contact with one of the latches along an interface that is superficially roughened at least partially.

9. The textile machine in accordance with claim 6 wherein the latch and the control element work as a pair wherein at least one has a depression for facilitating gripping.

10. The textile machine in accordance with claim 5 wherein the latch and the control element work as a pair wherein at least one has a depression for facilitating gripping.

11. The textile machine in accordance with claim 10 comprising:

spring means for urging said latches into a non-working position, the activating arrangement being mounted to reciprocate along a path to perform prior to displacement of selected ones of the stroke elements a predetermined motion for first driving the latches into the non-working position in opposition to said spring means.

12. The textile machine in accordance with claim 8 comprising:

spring means for urging said latches into a non-working position, the activating arrangement being mounted to reciprocate along a path to perform prior to displacement of selected ones of the stroke elements a predetermined motion for first driving the latches into the non-working position in opposition to said spring means.

13. The textile machine in accordance with claim 5 comprising:

spring means for urging said latches into a non-working position, the activating arrangement being mounted to reciprocate along a path to perform prior to displacement of selected ones of the stroke elements a predetermined motion for first driving the latches into the non-working position in opposition to said spring means.

14. The textile machine in accordance with claim 4 wherein the control elements comprise:

a cantilevered plurality of piezoelectric transducers.

15. The textile machine in accordance with claim 3 wherein the control elements comprise:

a cantilevered plurality of piezoelectric transducers.

16. The textile machine in accordance with claim 1 wherein the control elements comprise:

a cantilevered plurality of piezoelectric transducers.

17. The textile machine in accordance with claim 16 wherein the carrier has a longitudinal direction, said transducers being parallel, adjacent and separated from the stroke elements, the stroke elements having free ends that are displaceable in the longitudinal direction of the carrier.

18. The textile machine in accordance with claim 16 wherein the transducers are mounted in substantial alignment with the stroke elements to engage symmetrically the stroke elements.

19. The textile machine in accordance with claim 3 wherein the transducers are mounted in substantial alignment with the stroke elements to engage symmetrically the stroke elements.

20. The textile machine in accordance with claim 4 wherein the control elements are segregated into a plurality of groups, each group being commonly supported as a unit and having a cable with a plurality of electronic conductors, and a plug means connected to said cable.

21. The textile machine in accordance with claim 3 wherein the control elements are segregated into a plurality of groups, each group being commonly supported as a unit and having a cable with a plurality of electronic conductors, and a plug means connected to said cable.

22. The textile machine in accordance with claim 1 wherein the control elements are segregated into a plurality of groups, each group being commonly supported as a unit and having a cable with a plurality of electronic conductors, and a plug means connected to said cable.

23. The textile machine in accordance with any of claim 20 wherein each stoke element comprises:

a setting member; and a removable thread guide attached to said setting member.

24. The textile machine in accordance with any of claim 1 wherein each stoke element comprises:

a setting member; and a removable thread guide attached to said setting member.

* * * * *